US011149757B2

(12) United States Patent
Yumoto et al.

(10) Patent No.: US 11,149,757 B2
(45) Date of Patent: Oct. 19, 2021

(54) HYDRAULIC DRIVE APPARATUS FOR WORK MACHINE

(71) Applicant: KOBELCO CONSTRUCTION MACHINERY CO., LTD., Hiroshima (JP)

(72) Inventors: Natsuki Yumoto, Hiroshima (JP); Masahiro Kawamoto, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 17/177,269

(22) Filed: Feb. 17, 2021

(65) Prior Publication Data

US 2021/0277630 A1 Sep. 9, 2021

(30) Foreign Application Priority Data

Mar. 6, 2020 (JP) ..... JP2020-038412

(51) Int. Cl.
*F15B 11/042* (2006.01)
*E02F 9/22* (2006.01)

(52) U.S. Cl.
CPC ..... *F15B 11/0423* (2013.01); *E02F 9/2235* (2013.01); *E02F 9/2296* (2013.01); *E02F 9/2228* (2013.01); *F15B 2211/45* (2013.01)

(58) Field of Classification Search
CPC ..... F15B 9/04; F16H 61/4052
See application file for complete search history.

(56) References Cited

U.S. PATENT DOCUMENTS 5,129,230 A * 7/1992 Izumi ..... E02F 9/2225 60/452
5,222,870 A * 6/1993 Budzich ..... F15B 11/055 417/222.1

(Continued)

FOREIGN PATENT DOCUMENTS

EP 0 681 106 A1 11/1995
GB 2 298 291 A 8/1996

(Continued)

OTHER PUBLICATIONS

The extended European search report dated Jul. 12, 2021 in corresponding European Patent Application No. 21159505.3 (9 pages).

*Primary Examiner* — Michael Leslie
(74) *Attorney, Agent, or Firm* — Oblon, McClelland, Maier & Neustadt, L.L.P.

(57) ABSTRACT

Provided is a hydraulic drive apparatus of a work machine capable of reducing a surge pressure. The hydraulic drive apparatus includes a control valve interposed between the hydraulic pump and a hydraulic actuator, an operation device moving the control valve in response to an actuator operation, an unload valve, an unload operation valve changing a pilot pressure of the unload valve in response to an input of an unload operation command, a target pressure calculation part, and an unload operation command part. The target pressure calculation part calculates a target pressure that increases with an increase in the holding pressure of the hydraulic actuator. The unload operation command part inputs an unload operation command to the unload operation valve to make the pump pressure of the hydraulic pump follow the target pressure.

5 Claims, 6 Drawing Sheets

(56) References Cited

U.S. PATENT DOCUMENTS

| | | | | |
|---|---|---|---|---|
| 5,680,760 | A * | 10/1997 | Lunzman | E02F 9/2228 60/426 |
| 6,173,572 | B1 * | 1/2001 | Cobo | E02F 9/2203 60/327 |
| 6,378,303 | B1 * | 4/2002 | Higuchi | F15B 11/042 60/468 |
| 10,794,045 | B2 * | 10/2020 | Muraoka | E02F 9/2228 |
| 10,851,809 | B2 * | 12/2020 | Kondo | F15B 11/165 |
| 2004/0231326 | A1 | 11/2004 | Imanishi et al. | |
| 2008/0173014 | A1 | 7/2008 | Umezu et al. | |
| 2021/0002867 | A1 * | 1/2021 | Muraoka | E02F 9/2228 |
| 2021/0071391 | A1 | 3/2021 | Takahashi et al. | |

FOREIGN PATENT DOCUMENTS

| | | | |
|---|---|---|---|
| JP | 8-93705 | A | 4/1996 |
| JP | 2004-347040 | A | 12/2004 |
| JP | 2007-270982 | A | 10/2007 |
| JP | 2008-180287 | A | 8/2008 |
| WO | 2019/187489 | A1 | 10/2019 |

* cited by examiner

HYDRAULIC DRIVE APPARATUS FOR WORK MACHINE

TECHNICAL FIELD

The present invention relates to an apparatus for hydraulically driving a movable element included in a work machine.

BACKGROUND ART

A hydraulic drive apparatus installed in a work machine includes, for example, as described in JP-A-2004-347040, a hydraulic pump that discharges hydraulic fluid, a hydraulic actuator coupled to a movable element of the work machine, a control valve interposed between the hydraulic pump and the hydraulic actuator, an operation device to which an operation for moving the control valve is applied, and a relief valve. The hydraulic actuator is operated by hydraulic fluid supplied from the hydraulic pump to actuate the movable element in a specific direction. The control valve is formed of a hydraulic pilot-operated selector valve, which is opened in response to a pilot pressure that is input to the control valve to thereby change the direction and flow rate of the hydraulic fluid supplied from the hydraulic pump to the hydraulic actuator. The operation device is constituted by, for example, an operation lever and a remote-control valve. The remote-control valve allows a pilot pressure corresponding to the operation applied to the operation lever to be applied to the control valve, thereby making the control valve perform an opening motion corresponding to the operation. The relief valve restricts the pump pressure so as to fix an upper limit of the circuit pressure.

In the above-described hydraulic drive apparatus, however, the pump pressure which is the discharge pressure of the hydraulic pump may be suddenly raised upon the start of the hydraulic actuator to significantly affect the operation of the engine. Specifically, if an operation is applied to the operation lever, when the hydraulic actuator is stationary, to thereby increase the discharge amount of the pump and opens the control valve greatly, a state is instantaneously caused in which the function of the check valve for adjusting the pump pressure by the relief valve cannot catch up with the pump pressure that increases until the hydraulic actuator actually starts to move. This may cause the pump pressure to jump up to a pressure corresponding to the load of the hydraulic actuator, that is, may cause a so-called surge pressure. The surge pressure sharply increases the load torque of the engine to thereby reduce the engine speed. This may reduce the flow rate of hydraulic fluid supplied from the hydraulic pump to the hydraulic actuator to lower the response at startup.

In JP-A-2004-347040, in order to reduce energy loss in the relief valve interposed between the hydraulic pump and the tank, it is described to form the hydraulic pump of a variable displacement type hydraulic pump and to adjust the capacity of the hydraulic pump so as to make the relief flow rate, which is the flow rate of hydraulic fluid flowing through the relief valve, closer to zero. Such control, however, cannot effectively reduce the surge pressure.

SUMMARY OF INVENTION

It is an object of the present invention to provide a hydraulic drive apparatus installed in a work machine, the hydraulic drive apparatus enabling a hydraulic actuator to be reliably started in response to the opening of a control valve and effectively restraining a surge pressure from occurring at the time when the control valve is opened.

Provided is a hydraulic drive apparatus installed in a work machine including a movable element to hydraulically drive the movable element. The hydraulic drive apparatus includes a hydraulic pump, a hydraulic actuator, a control valve, an operation device, a pump pressure detector, an actuator holding pressure detector, an unload valve, an unload operation valve, a target pressure calculation part, and an unload operation command part. The hydraulic pump discharges hydraulic fluid. The hydraulic actuator is coupled to the movable element and operated to actuate the movable element by supply of hydraulic fluid discharged by the hydraulic pump to the hydraulic actuator. The control valve is interposed between the hydraulic pump and the hydraulic actuator, being openable so as to allow hydraulic fluid to be supplied from the hydraulic pump to the hydraulic actuator. The operation device receives an actuator operation for moving the hydraulic actuator to thereby make the control valve open in response to the actuator operation. The pump pressure detector detects a pump pressure which is a pressure of hydraulic fluid discharged by the hydraulic pump. The actuator holding pressure detector detects an actuator holding pressure that is a pressure required for holding the hydraulic actuator in a stopped state against a load applied to the hydraulic actuator. The unload valve is formed of a pilot-operated selector valve having a pilot port and provided in an unload line, configured to be opened at an opening degree corresponding to a pilot pressure to be input to the pilot port to thereby allow the hydraulic fluid to flow through the unload line at a flow rate corresponding to the opening degree. The unload line is disposed to allow hydraulic fluid discharged from the hydraulic pump to bypass the control valve and the hydraulic actuator to return directly to the tank. The unload operation valve is formed of a solenoid valve allowing an unload operation command to be input to the unload operation valve, being operable to change the pilot pressure to be input to the unload valve in response to the unload operation command. The target pressure calculation part calculates a target pressure of the pump pressure based on the actuator holding pressure detected by the actuator holding pressure detector. The target pressure calculation part calculates the target pressure so as to make the target pressure equal to or higher than a minimum pressure required for moving the hydraulic actuator against the load and equal to or lower than a preset restriction pressure. The unload operation command part generates the unload operation command and inputs the unload operation command to the unload operation valve. The unload operation command is a command to make the pump pressure detected by the pump pressure detector follow the target pressure.

DESCRIPTION OF EMBODIMENTS

Hereinafter, preferred embodiments of the present invention will be described with reference to the drawings.

Figure 1:
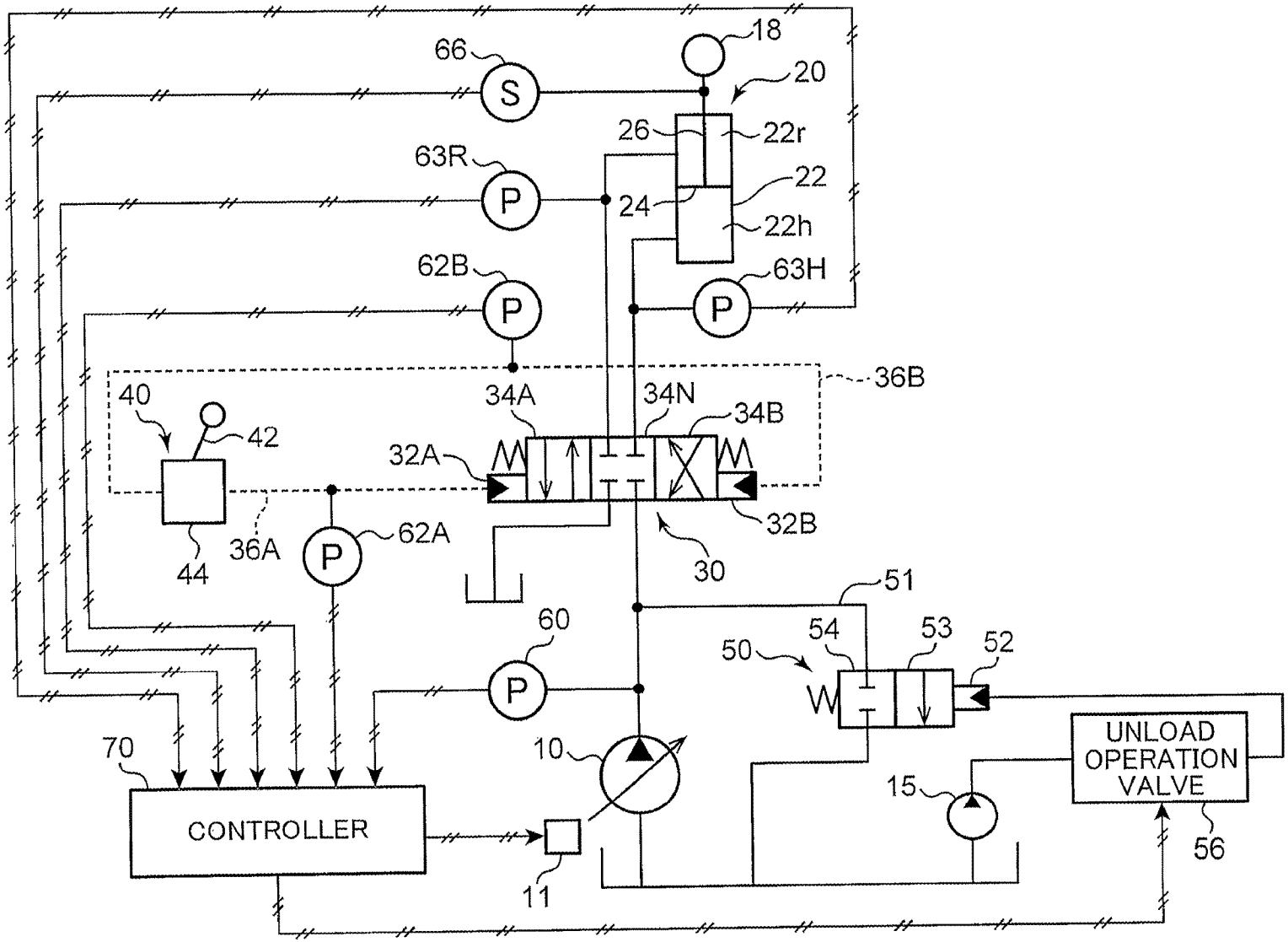
FIG. 1 is a circuit diagram showing a hydraulic drive apparatus of a work machine according to an embodiment of the present invention.

FIG. 1 is a circuit diagram showing a hydraulic drive apparatus of a work machine according to an embodiment of the present invention. The hydraulic drive apparatus includes a hydraulic pump 10, a hydraulic cylinder 20, a control valve 30, an operation device 40, an unload valve 50, an unload operation valve 56, a plurality of sensors, and a controller 70.

The work machine includes at least one movable element which is hydraulically movable. The work machine is, for example, a hydraulic excavator, a hydraulic crane, or a hydraulic dismantling machine. In the case of a hydraulic excavator as the work machine, the at least one movable element includes a boom, an arm and a bucket that constitute a work attachment, a crawler included in the lower traveling body to perform a traveling motion, an upper slewing body to be slewed about a vertical axis to the lower traveling body, and the like.

The hydraulic pump 10 is driven by an engine mounted on the work machine, thereby being operated to discharge hydraulic fluid in the tank. The hydraulic pump 10 according to this embodiment is a variable displacement hydraulic pump, which includes a pump body having a variable pump capacity (displacement volume), and a regulator 11 for changing the pump capacity. The regulator 11 receives an input of a capacity command signal from the controller 70, thereby operating the pump body so as to make the capacity of the pump body be a capacity corresponding to the capacity command signal.

The hydraulic cylinder 20 is an example of a hydraulic actuator according to the present invention. The hydraulic cylinder 20 is coupled to a specific movable element 18 and expanded and contracted to actuate the movable element 18 in the expansion and contraction direction by supply of hydraulic fluid discharged from the hydraulic pump 10 to the hydraulic cylinder 20. The specific movable element 18 is selected from the at least one movable element. In the case of the work machine as the hydraulic excavator, the hydraulic cylinder 20 is, for example, a boom cylinder for rotationally actuating the boom, an arm cylinder for rotationally actuating the arm, or a bucket cylinder for rotationally actuating the bucket.

The hydraulic actuator according to the present invention may be an actuator other than a hydraulic cylinder, for example, a hydraulic motor. In the case of the hydraulic excavator as the work machine, the hydraulic motor is, for example, a slewing motor for stewing the upper slewing body, or a traveling motor for bringing the crawler into a traveling motion.

The hydraulic cylinder 20 includes a cylinder body 22, a piston 24, and a cylinder rod 26. The cylinder body 22 is cylindrical to enclose a cylinder chamber. The piston 24 is stored in the cylinder body 22 to partition the cylinder chamber into a head-side chamber **22*h* and a rod-side chamber 22*r*. The cylinder rod 26 extends from the piston 24 in a direction to axially penetrate the rod-side chamber 22*r*, protruding to the outside of the cylinder body 22 to be connected to the movable element 18 that is a driving target. The hydraulic cylinder 20 is expanded, with discharge of hydraulic fluid from the rod-side chamber 22*r*, by supply of hydraulic fluid to the head-side chamber 22*h*; conversely, the hydraulic cylinder 20 is contracted, with discharge of hydraulic fluid from the head-side chamber 22*h*, by supply of hydraulic fluid to the rod-side chamber 22*r***.

The control valve 30 is interposed between the hydraulic pump 10 and the hydraulic cylinder 20 that is a hydraulic actuator. Being closed, the control valve 30 prevents hydraulic fluid from being supplied to the hydraulic cylinder 20 from the hydraulic pump 10. Being opened with an appropriate opening area, the control valve 30 allows hydraulic fluid to be supplied to the hydraulic cylinder 20 at a flow rate corresponding to the opening area.

The control valve 30 according to this embodiment is formed of a pilot-operated three-position direction selector valve. The control valve 30, specifically, has a first pilot port 32A and a second pilot port 32B, each of which allows a pilot pressure to be input thereto.

The control valve 30 is kept in a neutral position 34N with no input of the pilot pressure to any of the first and second pilot ports 32A and 32B. The control valve 30, specifically, is thereby closed to block the communication between the hydraulic pump 10 and the hydraulic cylinder 20, i.e., block the supply of hydraulic fluid from the hydraulic pump 10 to the hydraulic cylinder 20.

By supply of the pilot pressure to the first pilot port 32A, the control valve 30 is shifted from the neutral position 34N to a first driving position 34A by a stroke corresponding to the magnitude of the pilot pressure. The control valve 30, thus, is opened with an opening area corresponding to the stroke. The control valve 30, thereby, forms a first supply passage and a first return passage. The first supply passage allows hydraulic fluid discharged from the hydraulic pump 10 to be supplied to the head-side chamber **22*h* of the hydraulic cylinder 20 at a flow rate corresponding to the opening area. The first return passage allows hydraulic fluid discharged from the rod-side chamber 22*r* of the hydraulic cylinder 20** to return to the tank.

By supply of the pilot pressure to the second pilot port 32B, conversely, the control valve 30 is shifted from the neutral position 34N to a second driving position 34B by a stroke corresponding to the magnitude of the pilot pressure. The control valve 30, thus, is opened with an opening area corresponding to the stroke. The control valve 30 thereby forms a second supply passage and a second return passage. The second supply passage allows hydraulic fluid discharged from the hydraulic pump 10 to be supplied to the rod-side chamber **22*r* of the hydraulic cylinder 20 at a flow rate corresponding to the opening area. The second return passage allows hydraulic fluid discharged from the head-side chamber 22*h* of the hydraulic cylinder 20** to return to the tank.

The operation device 40 receives a cylinder operation to thereby operate to input a pilot pressure corresponding to the cylinder operation to the control valve 30. The cylinder operation is an actuator operation that is applied to the operation device 40 by an operator to move the hydraulic cylinder 20 which is the hydraulic actuator. The operation device 40 makes the control valve 30 open in response to the cylinder operation applied to the operation device 40, thereby enabling the hydraulic cylinder 20 connected to the control valve 30 to be operated.

The operation device 40 according to this embodiment, specifically, includes an operation lever 42 and a pilot valve 44. To the operation lever 42 is selectively applied, as the cylinder operation, an operation of tilting down the operation lever 42 in a first direction and an operation of tilting down the operation lever 42 in a second direction opposite to the first direction. The pilot valve 44 has an inlet port and a pair of outlet ports. The inlet port is connected to a pilot hydraulic source, e.g., a pilot pump 15 shown in FIG. 1. The pair of outlet ports are connected to the first and second pilot ports 32A and 32B through a first pilot line 36A and a second pilot line 36B, respectively. The pilot valve 44 is coupled to the operation lever 42 to perform a valve opening motion in conjunction with the movement of the operation lever 42. The pilot valve 44 is opened so as to allow pilot pressure to be input from the pilot pressure supply source to one of the first and second pilot ports 32A and 32B in response to the cylinder operation applied to the operation lever 42. The pilot pressure has a magnitude corresponding to the amount of the cylinder operation.

The unload valve 50 is provided in an unload line 51. The unload line 51 is a line that allows hydraulic fluid discharged from the hydraulic pump 10 to bypass the control valve 30 and the hydraulic cylinder 20 to return directly to the tank.

The unload valve 50 is a selector valve to be pilot-operated, namely, a pilot-operated selector valve, having a flow adjustment function. The unload valve 50, specifically, has a single pilot port 52 connected to the pilot pump 15, configured to be opened with an opening area corresponding to the magnitude of the pilot pressure that is input from the pilot pump 15 to the pilot port 52, thereby letting hydraulic fluid discharged from the hydraulic pump 10 released to the tank through the unload line 51 at a flow rate corresponding to the opening area. The unload valve 50 according to this embodiment is held in a close position 53 with no input of pilot pressure to the pilot port 52, completely blocking the unload line 51. By input of pilot pressure to the pilot port 52, the unload valve 50 is shifted from the close position 53 to an open position 54 by a stroke corresponding to the magnitude of the pilot pressure, thus opened with the opening area corresponding to the stroke.

The unload operation valve 56 is interposed between the pilot pump 15 and the pilot port 52, and performs an opening/closing motion so as to change the pilot pressure that is input from the pilot pump 15 to the pilot port 52. The unload operation valve 56 is formed of a solenoid valve having a solenoid, configured to be opened at an opening degree corresponding to an unload operation command applied to the solenoid from the controller 70 to thereby allow the pilot pressure corresponding to the unload operation command to be input to the pilot port 52. The unload operation command is, specifically, an excitation current flowing through the solenoid. The solenoid valve may be either a solenoid proportional valve which is opened at an opening degree proportional to the excitation current or a solenoid inversely proportional valve which is opened at an opening degree decreased with increase in the excitation current.

Each of the plurality of sensors detects information for enabling an arithmetic control operation to be performed by the controller 70, generating an electrical signal (detection signal) containing the information and inputting the signal to the controller 70. The plurality of sensors according to this embodiment includes a pump pressure sensor 60, a head pressure sensor 63H, a rod pressure sensor 63R, a cylinder speed sensor 66, a first pilot pressure sensor 62A, and a second pilot pressure sensor 62B.

The pump pressure sensor 60 is a pump pressure detector that detects a pump pressure Pd of the hydraulic pump 10, that is, the pressure of hydraulic fluid discharged from the hydraulic pump 10.

The head pressure sensor 63H and the rod pressure sensor 63R detect the head pressure Ph and the rod pressure Pr in the hydraulic cylinder 20, respectively. The head pressure sensor 63H and the rod pressure sensor 63R can serve as an actuator holding pressure detector that detects an actuator holding pressure Pah. The actuator holding pressure Pah, in this embodiment, is a pressure for holding the hydraulic cylinder 20 in a stopped state against the load acting thereon, namely, a cylinder holding pressure.

The head pressure Ph is the pressure of hydraulic fluid in the head-side chamber 22*h*, which is a pressure for holding the hydraulic cylinder 20 in a stopped state against a load acting on the hydraulic cylinder 20 in the direction to contract the hydraulic cylinder 20. The rod pressure Pr is the pressure of hydraulic fluid in the rod-side chamber 22*r*, which is a pressure for holding the hydraulic cylinder 20 in the stopped state against a load acting on the hydraulic cylinder 20 in the direction to expand the hydraulic cylinder 20. Accordingly, the rod pressure sensor 63R serves as the actuator holding pressure detector when a load acts to cause the hydraulic cylinder 20 to be driven in the expansion direction, and the head pressure sensor 63H serves as the actuator holding pressure detector when a load acts to cause the hydraulic cylinder 20 to be driven in the contraction direction.

The cylinder speed sensor 66 detects a cylinder speed Sc. The cylinder speed Sc is the speed at which the hydraulic cylinder 20 is expanded and contracted, that is, the axial movement speed of the cylinder rod 26 relative to the cylinder body 22. The cylinder speed sensor 66, therefore, can serve as an actuator motion detector that detects presence or absence of the motion of the hydraulic cylinder 20 that corresponds to the hydraulic actuator according to the present invention is operated.

The actuator motion detector according to the present invention is not limited to such a speed sensor. The actuator motion detector may be, for example, either a combination of a position sensor for detecting the axial position of the cylinder rod 26 relative to the cylinder body 22 and a differentiator for time differentiating the axial position thereof or the combination of an acceleration sensor for detecting the acceleration of the cylinder rod 26 and an integrator for integrating the acceleration. In the case where the hydraulic actuator according to the present invention is a hydraulic motor, the actuator motion detector can be formed of, for example, a combination of a rotary encoder for detecting the rotation angle of the hydraulic motor and a differentiator for time differentiating the detected rotation angle.

Each of the first and second pilot pressure sensors 62A and 62B is configured to detect a pilot pressure that is input from the operation device 40 to the control valve 30 in response to the cylinder operation (actuator operation), corresponding to the actuator operation detector. The first pilot pressure sensor 62A, specifically, detects an expansion drive pilot pressure. The expansion drive pilot pressure is a pilot pressure that is input from the operation device 40 to the first pilot port 32A through the first pilot line 36A. The second pilot pressure sensor 62B detects a contraction drive pilot pressure. The contraction drive pilot pressure is a pilot pressure that is input from the operation device 40 to the second pilot port 32B through the second pilot line 36B.

Figure 2:
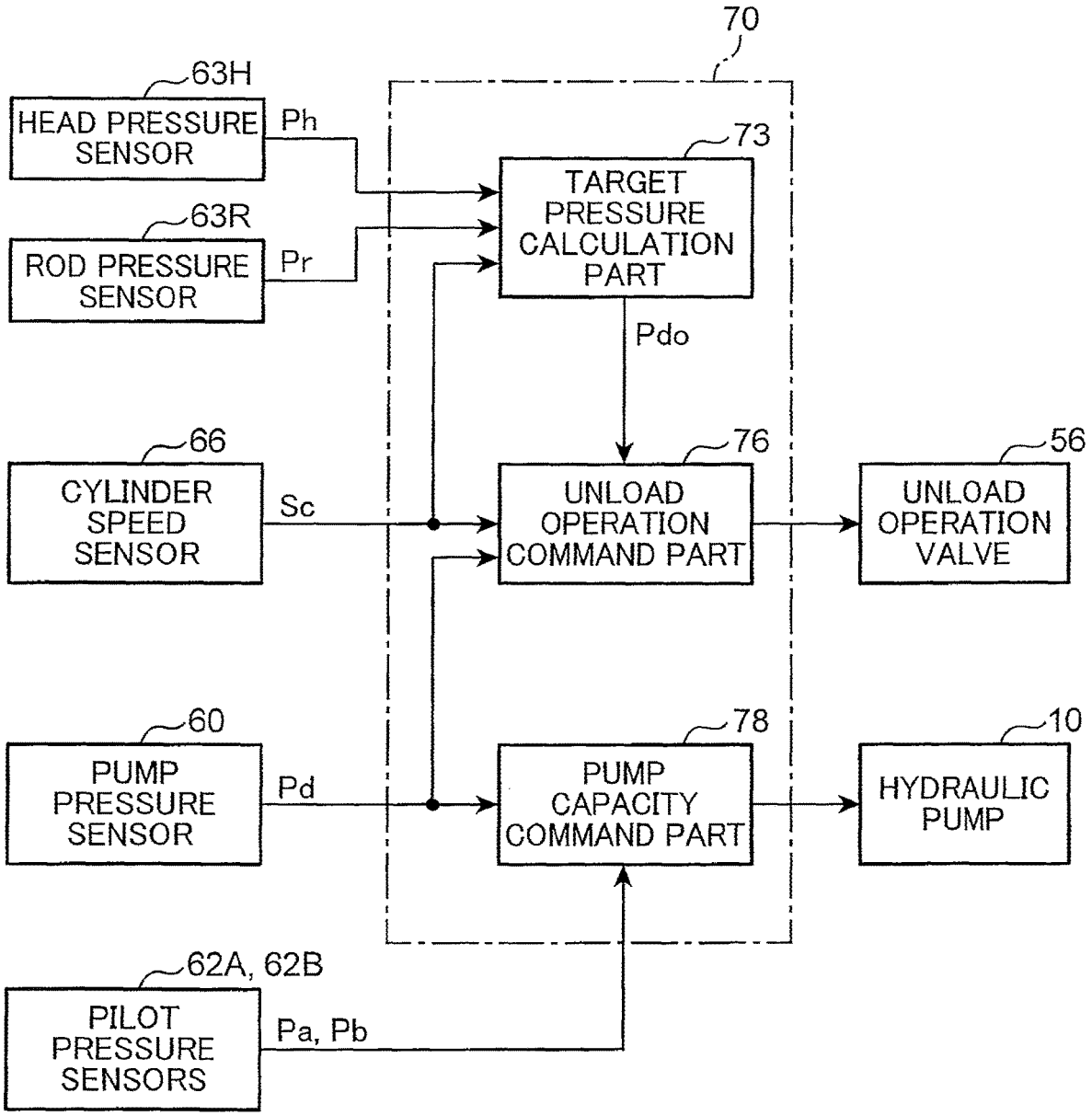
FIG. 2 is a block diagram showing a functional configuration of a controller included in the hydraulic drive apparatus.

The controller 70 performs a control of the pump pressure Pd of the hydraulic pump 10 through the operation of the unload valve 50 and a control of the pump capacity of the hydraulic pump 10. The controller 70, specifically, as functions for executing the controls, includes a target pressure calculation part 73, an unload operation command part 76, and a pump capacity command part 78, which are shown in FIG. 2.

The target pressure calculation part 73 calculates a target pressure Pdo for the pump pressure Pd. The target pressure Pdo, as described in detail below, is calculated based on the actuator holding pressure Pah. Specifically, the larger the actuator holding pressure Pah, the larger the target pressure Pdo is calculated.

The unload operation command part 76 generates an unload operation command based on the target pressure Pdo, an actual pump pressure Pd detected by the pump pressure sensor 60, and a cylinder speed Sc detected by the cylinder speed sensor 66, and inputs the unload operation command to the solenoid of the unload operation valve 56. This changes the pilot pressure that is input to the unload valve 50, in accordance with the unload operation command, allowing the opening degree of the unload valve 50 to be adjusted to the opening corresponding to the magnitude of the pilot pressure.

The pump capacity command part 78 generates a pump capacity command based on the pump pressure Pd and the pilot pressure detected by the first and second pilot pressure sensors 62A and 62B, and inputs the pump capacity command to the regulator 11 of the hydraulic pump 10 to thereby performs pump capacity control for the hydraulic pump 10. The pump capacity command part 78 according to this embodiment generates a pump capacity command for executing a positive control and a horsepower control as the pump capacity control. The positive control is a control for increasing the capacity of the hydraulic pump 10 with an increase in the pilot pressure detected by the first and second pilot pressure sensors 62A and 62B, that is, an increase in the cylinder operation (actuator operation). The horsepower control is a control for restricting the pump horsepower calculated based on the pump pressure Pd and the pump capacity, based on the horsepower curve of the engine, wherein the pump horsepower is a horsepower required for driving the hydraulic pump 10.

Next will be described the arithmetic control operation actually performed by the controller 70 and the action of the apparatus accompanying the arithmetic control operation, with reference to the flowchart of FIG. 3 and the graph of FIG. 4.

The controller 70 acquires detection signals generated by the plurality of sensors in step S10, and performs the following arithmetic control based on the detection signals.

(1) Determination of the Actuator Holding Pressure Pah (Step S11)

With the absence of the cylinder operation (actuator operation), the pilot pressure detected by each of the first and second pilot pressure sensors 62A and 62B is substantially zero, the hydraulic cylinder 20 being held in a stopped state. The head pressure Ph and the rod pressure Pr in the hydraulic cylinder 20 at this time are detected by the head pressure sensor 63H and the rod pressure sensor 63R, respectively. The target pressure calculation part 73 of the controller 70 selects the larger one out of the detected head pressure Ph and the rod pressure Pr to determine it as the actuator holding pressure (cylinder holding pressure) Pah.

In the case where the hydraulic cylinder 20 is a boom cylinder, specifically, there acts a gravitational force on each of the boom, the arm, and the bucket that constitute the work attachment, and an object held by the bucket. The head pressure Ph of the boom cylinder for holding the boom cylinder in the stopped state against the above gravity is greater than the rod pressure Pr of the boom cylinder. Accordingly, in this case, the target pressure calculation part 73 determines the head pressure Ph of the boom cylinder as the actuator holding pressure.

(2) Judgment on the Presence or Absence of Cylinder Operation (Actuator Operation) (Step S12)

The unload operation command part 76 of the controller 70 judges whether the cylinder operation (actuator operation) is present or absent. This judgment is made based on the presence or absence of the pilot pressure detected by each of the first and second pilot pressure sensors 62A and 62B. When a pilot pressure is detected by one of the first and second pilot pressure sensors 62A and 62B, that is, when the cylinder operation is detected (YES in step S12), the process of step S13 described later is performed. When no pilot pressure is detected by any of the first and second pilot pressure sensors 62A and 62B (NO in step S12), the unload operation command part 76 performs the process of the next step S18.

(3) Standby Control (Step S18 and Step S20)

When no cylinder operation (no actuator operation) is detected (NO in step S12), the control valve 30 is kept in the neutral position 34N, being fully closed. In the neutral position 34N, the control valve 30 blocks each of the passage between the hydraulic pump 10 and the hydraulic cylinder 20 and the passage between the tank and the hydraulic cylinder 20 to keep the hydraulic cylinder 20 stopped. The pump capacity command part 78 of the controller 70 inputs a capacity signal command to minimize the pump capacity of the hydraulic pump 10 to the regulator 11. The unload operation command part 76 of the controller 70, meanwhile, inputs an unload operation command to the unload operation valve 56 for making such a pilot pressure as to cause the unload valve 50 to be fully or substantially opened be input to the unload valve 50 (step S18 and step S20). Such an operation of opening the unload valve 50 restricts the circuit pressure to a standby pressure Pwt that is close to the minimum pressure, thereby minimizing the load on the engine.

(4) Calculation of Target Pressure (YES in Step S13, and Step S14).

When the cylinder operation (actuator operation) is detected (YES in step S12), the target pressure calculation part 73 judges whether or not the actual cylinder speed Sc detected by the cylinder speed sensor 66 is less than a preset motion judgment speed Sco (step S13). The motion judgment speed Sco is a speed set for the cylinder speed Sc as shown in FIG. 4 in order to judge whether or not the hydraulic cylinder 20 actually has started to move (operate), having a minute value.

When the cylinder speed Sc is less than the motion judgment speed Sco (YES in step S13), that is, the hydraulic cylinder 20 can be considered to have not started to move yet, the target pressure calculation part 73 calculates the target pressure Pdo for the pump pressure Pd (step S14).

As the feature of this embodiment, the target pressure calculation part 73 calculates the target pressure Pdo based on the actuator holding pressure Pah that is the holding pressure of the hydraulic cylinder 20. When a load acts on the hydraulic cylinder 20 in a direction to contract it, the actuator holding pressure Pah is a pressure for holding the hydraulic cylinder 20 in the stopped state against the load, namely, the head pressure Ph detected by the head pressure sensor 63H. When a load acts on the hydraulic cylinder 20 in a direction to expand it, the actuator holding pressure Pah is a pressure for holding the hydraulic cylinder 20 in the stopped state against the load, namely, the rod pressure Pr detected by the rod pressure sensor 63R.

The target pressure calculation part 73, specifically, calculates, as the target pressure Pdo, a pressure obtained by adding an operation pressure ΔPop and an addition pressure ΔPad to the actuator holding pressure Pah determined in step S11, that is, the holding pressure required for holding the hydraulic cylinder 20 in the stopped state against the load applied to the hydraulic cylinder 20 to expand or contract it. The operation pressure ΔPop is a pressure corresponding to the magnitude of the pilot pressure detected by the first pilot pressure sensor 62A, and the addition pressure ΔPad is a pressure corresponding to the pressure loss of hydraulic fluid from the hydraulic pump 10 to the hydraulic cylinder 20.

The actuator holding pressure Pah is included in the target pressure Pdo to bring up the pump pressure Pd to the actuator holding pressure Pah. The operation pressure ΔPop is included in the target pressure Pdo to vary the pump pressure Pd in response to the magnitude of the pilot pressure detected by the first pilot pressure sensor 62A. The addition pressure ΔPad includes a pressure loss in the control valve 30 and a pressure loss in each of the pipings, being included in the target pressure Pdo to provide such a pump pressure Pd as to reliably operate the hydraulic cylinder 20 against the pressure losses.

Specifically, as an example of the calculation for setting the target pressure Pdo, a calculation based on the following equation (1) is given.

$$Pdo=Pah+\Delta Pop+\Delta Pad \quad (1)$$

When a load acts on the hydraulic cylinder 20 in a direction to contract it, the actuator holding pressure Pah is a pressure for holding the hydraulic cylinder 20 in the stopped state against the load, namely, the head pressure Ph detected by the head pressure sensor 63H. When a load acts on the hydraulic cylinder 20 in a direction to expand it, the actuator holding pressure Pah is a pressure for holding the hydraulic cylinder 20 in the stopped state against the load, namely, the rod pressure Pr detected by the rod pressure sensor 63R. The operation pressure ΔPop corresponds to the magnitude of the pilot pressure detected by the first pilot pressure sensor 62A. The addition pressure ΔPad is set based on the pressure loss. The addition pressure ΔPad is set to a value larger than the pressure loss and so as to make the target pressure Pdo including the addition pressure ΔPad equal to or lower than a preset restriction pressure Pdr.

The addition pressure ΔPad, preferably, is set to a value that allows for a variation in the pressure loss. The pressure loss is varied with the state of the hydraulic fluid, for example, the temperature affecting the viscosity of hydraulic fluid, the kind of the hydraulic fluid, and the flow rate. The addition pressure ΔPad, for example, may be either set to a constant value slightly larger than the maximum value estimated for the pressure loss or set as a variable that varies depending on the temperature of the hydraulic fluid (may be air temperature) or the flow rate.

The restriction pressure Pdr is the upper limit pressure of the target pressure Pdo which is set for reducing a surge pressure. The restriction pressure Pdr is preferably set in consideration with an instantaneous increase in the pump pressure.

The calculation of the target pressure Pdo is not limited to the calculation based on the equation (1). The calculation may be performed by use of other mathematical expressions. Specifically, the calculation method can be appropriately set under the condition that the target pressure Pdo is equal to or higher than the minimum required pressure and equal to or lower than the restriction pressure Pdr. The minimum required pressure is the minimum pressure required for moving the hydraulic cylinder 20 against the load.

(5) Generation and Input of Unload Operation Command (Steps S16 and S20)

The unload operation command part 76 generates the following unload operation command according to the presence or absence of the operation of the hydraulic cylinder 20, that is, the magnitude relationship between the cylinder speed Sc and the motion judgment speed Sco in this embodiment.

At a stage where the cylinder speed Sc is less than the motion judgment speed Sco (YES in step S13), that is, at a stage where the hydraulic cylinder 20 is considered to have not yet substantially started to move, the unload operation command part 76 generates an unload operation command to make the actual pump pressure Pd detected by the pump pressure sensor 60 follow the target pressure Pdo (step S16). The unload operation command part 76 according to this embodiment, specifically, obtains the deviation δPd of the pump pressure Pd from the target pressure Pdo (δPd=Pd−Pdo), and generates an unload operation command for executing a feedback control (e.g., a PID control) of the pump pressure Pd based on the deviation δPd.

The unload operation command part 76 inputs the thus generated unload operation command to the unload operation valve 56 (step S20), thereby making the pilot pressure corresponding to the unload operation command be input to the pilot port 52 of the unload valve 50. The unload valve 50 is opened with an opening area corresponding to the pilot pressure, thereby letting hydraulic fluid discharged from the hydraulic pump 10 be released directly to the tank at a flow rate corresponding to the opening area.

Figure 5:
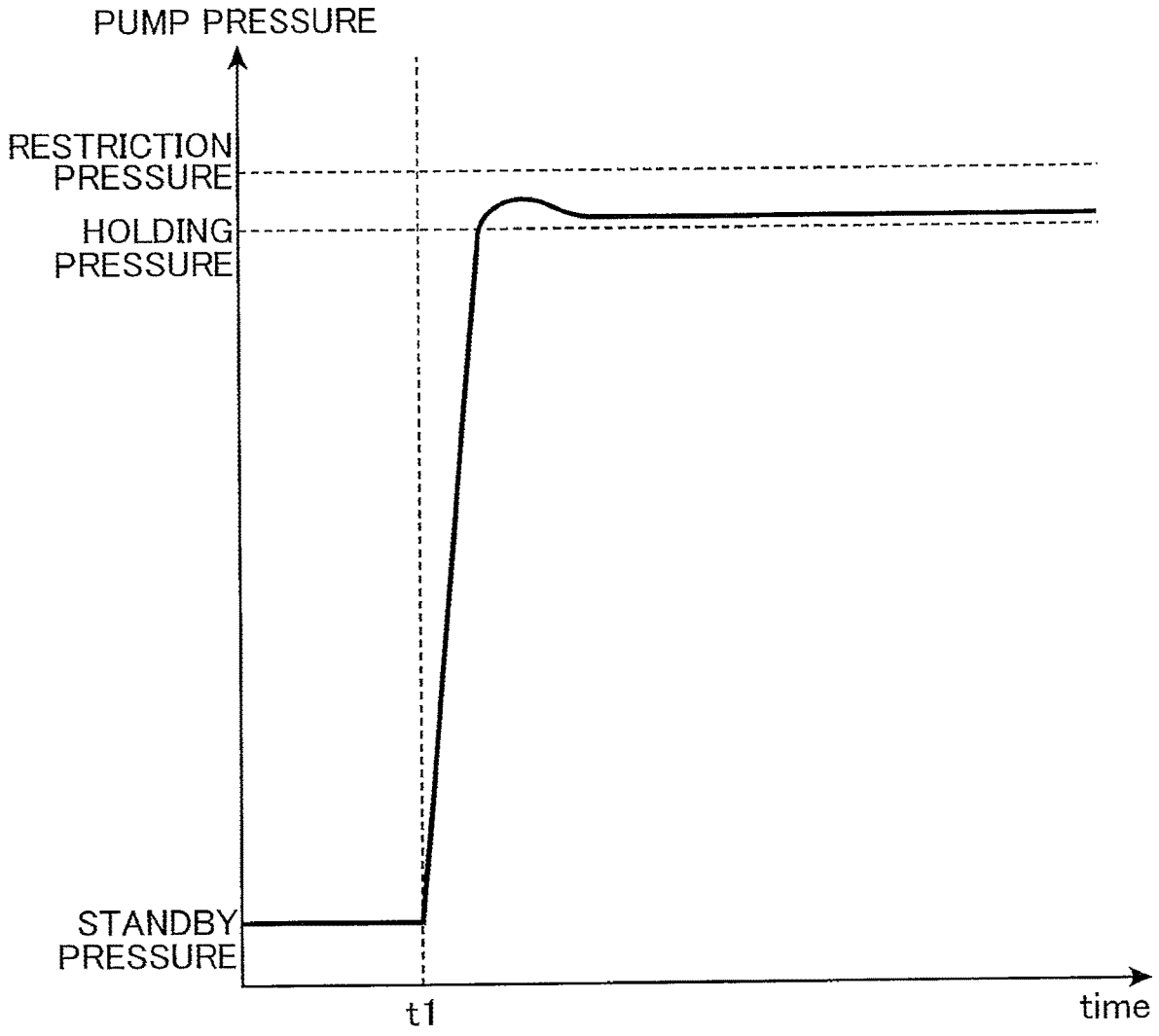
FIG. 5 is a graph showing an example of a temporal change in the pump pressure in the hydraulic drive apparatus.

FIG. 5 shows an example of the temporal variation in the thus controlled pump pressure Pd. In this example, no cylinder operation (no actuator operation) is detected until the time t1 (NO in step S12), the pump pressure Pd thus being maintained at the standby pressure Pwt. The cylinder operation (actuator operation) is detected after the time t1 (YES in step S12), and the controller 70 starts the control for making the pump pressure Pd follow the target pressure Pdo.

The target pressure Pdo is calculated to include the operation pressure ΔPop and the addition pressure ΔPad in addition to the actuator holding pressure Pah. When a load acts on the hydraulic cylinder 20 in a direction to contract it, the actuator holding pressure Pah is the head pressure Ph detected by the head pressure sensor 63H for holding the hydraulic cylinder 20 in a stopped state against the load; when a load acts on the hydraulic cylinder 20 in a direction to expand it, the actuator holding pressure Pah is the rod pressure Pr detected by the rod pressure sensor 63R for holding the hydraulic cylinder 20 in a stopped state against the load. The operation pressure ΔPop corresponds to the magnitude of the pilot pressure detected by the first pilot pressure sensor 62A. The addition pressure ΔPad is a pressure corresponding to the pressure loss, being set in consideration with the restriction pressure Pdr. The control based on the thus calculated target pressure Pdo allows the pump pressure Pd to exceed the actuator holding pressure Pah.

Because of a time lag from the time when the control valve 30 is opened until the time when the hydraulic cylinder 20 actually starts to move, the pump pressure Pd starts to be raised whereas the hydraulic cylinder 20 is still stationary.

The unload operation command part 76 generates such an unload operation command as to make the actual pump pressure Pd follow the target pressure Pdo calculated by the target pressure calculation part 73 of the controller 70 and inputs the unload operation command to the unload operation valve 56. Setting the addition pressure ΔPad makes it possible to hinder the pump pressure Pd from exceeding the restriction pressure Pdr to restrain a surge pressure from occurring. The restriction pressure Pdr is set to a pressure that allows a required-torque increase speed to be prevented from exceeding an outputable-torque increase speed. The outputable-torque increase speed is the increase speed of the torque able to be output by the engine, and the required-torque increase speed is the increase speed of the engine torque required for an instantaneous increase in the pump pressure Pd. Setting the restriction pressure Pdr effectively restrains the pump pressure Pd from being suddenly raised due to the sudden opening of the control valve 30 when the hydraulic cylinder 20 is stopped, that is, restrains a surge pressure from occurring.

After the hydraulic cylinder 20 starts to move, the pump pressure Pd is lowered to further reduce the possibility of generation of surge pressure.

Figure 4:
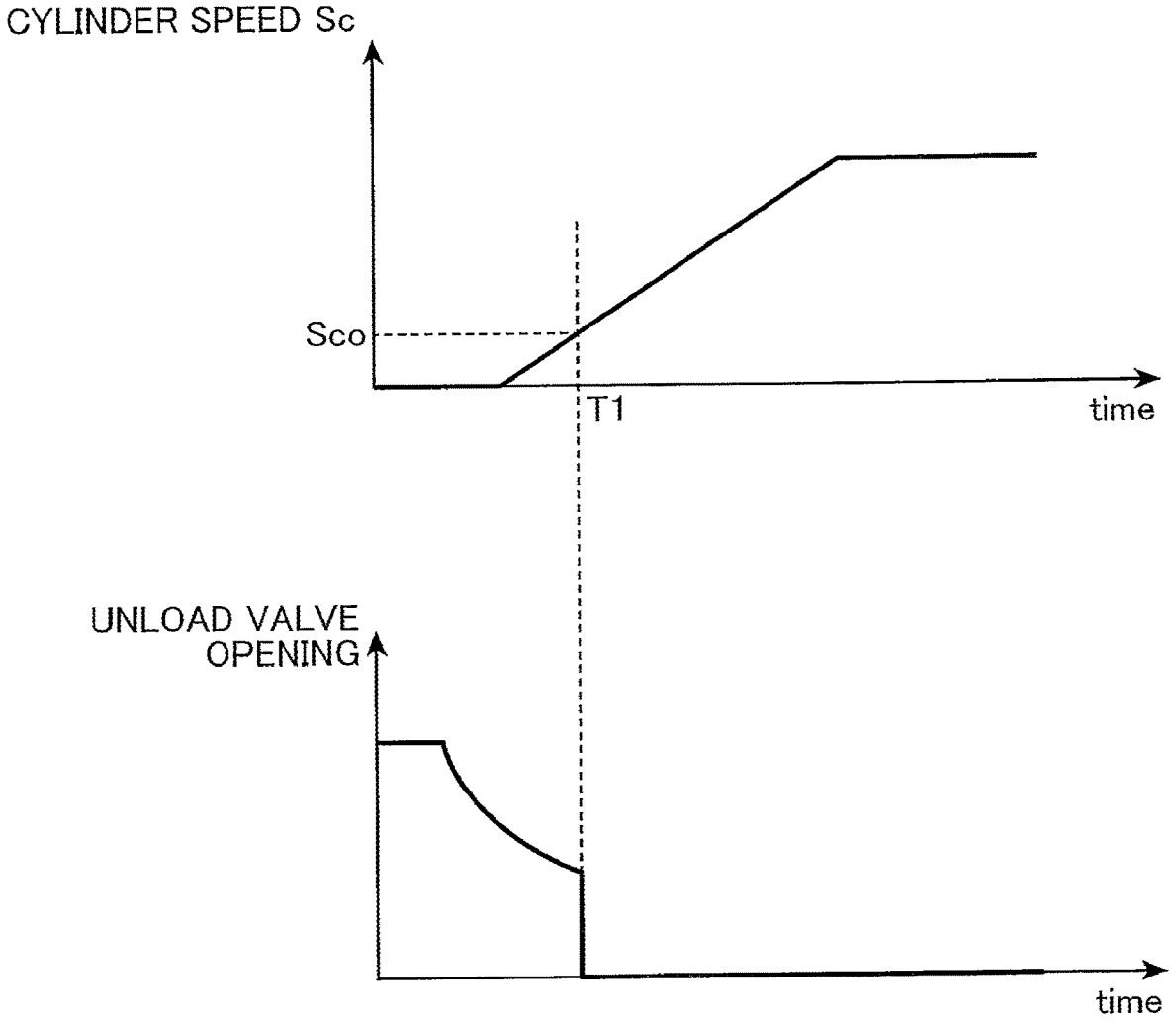
FIG. 4 is a graph showing an example of respective temporal changes in a cylinder speed which is the operation speed of a hydraulic cylinder in the hydraulic drive apparatus and the opening of the unload valve operated by the controller.

At the point T1 in time when the cylinder speed Sc reaches the motion judgment speed Sco as shown in FIG. 4 after the actual start of the movement of the hydraulic cylinder 20, namely, the start time (NO in step S13), the unload operation command part 76 generates such an unload operation command as to make the unload valve 50 fully closed regardless of the actual pump pressure Pd and inputs it to the unload operation valve 56 (step S17 and step S20). The hydraulic fluid discharged from the hydraulic pump 10 is thereby supplied to the hydraulic cylinder 20 while being prevented from being released through the unload line 51. This makes it possible to increase the flow rate of the hydraulic fluid supplied from the hydraulic pump 10 to the hydraulic cylinder 20 to ensure a high cylinder speed Sc.

The effect described above will be explained in comparison with the control according to the comparative example shown in FIG. 6. The control according to the comparative example is a control for ensuring the supply flow rate of the hydraulic fluid to the hydraulic actuator by fully closing the unload valve immediately following an actuator operation point T2 in time, at which an actuator operation is applied to the operation device. Thus making the unload valve fully closed from the previously fully open state before the start of the hydraulic actuator starts to move after the actuator operation is applied, that is, rapidly and greatly reducing the opening of the unload valve, can cause a large surge pressure Psg in the pump pressure. The surge pressure Psg is specifically expressed by the following equation (2).

$$Psg=\rho\times c\times\Delta V \tag{2}$$

In this equation (2), ρ is the density of the hydraulic fluid, c is the wave propagation speed, v is the change in the flow velocity of the hydraulic fluid.

Figure 6:
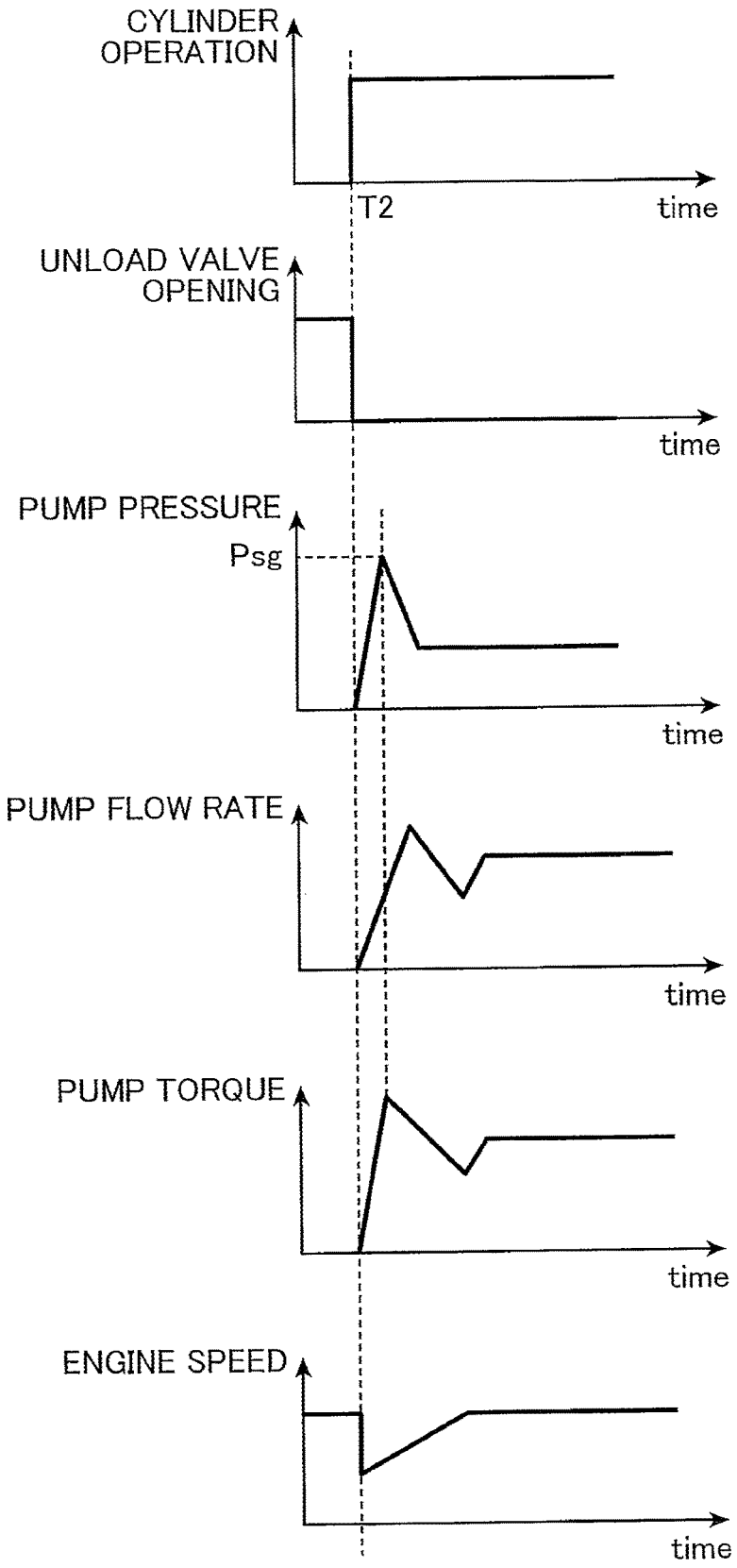
FIG. 6 is a graph showing an example of respective temporal changes in the pump pressure and others when the unload valve is suddenly closed accompanying the cylinder operation.

Such occurrence of surge pressure involves sudden increases in the pump flow rate and the pump torque, as shown in FIG. 6, thereby generating a possibility of a temporary and significant decrease in the engine speed. As means for reducing such a sudden increase in the pump torque, it is not always effective to reduce the pump capacity of the variable displacement type hydraulic pump with an increase in the pump pressure. That is because there exists a large response delay before the pump capacity is actually decreased and the torque is decreased after the controller changes the capacity command signal to be input to the hydraulic pump.

Figure 3:
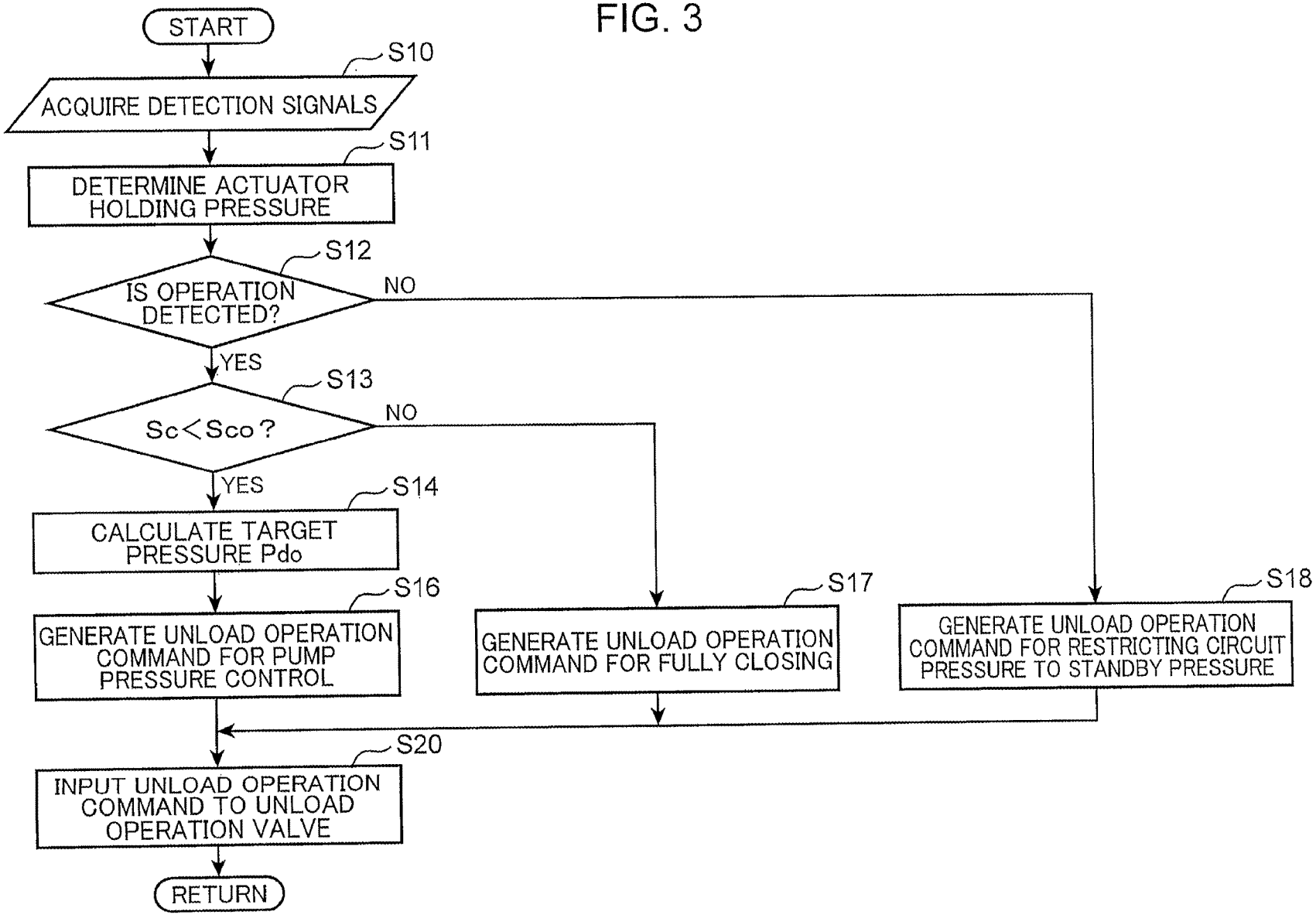
FIG. 3 is a flowchart showing an arithmetic control operation performed by the controller.

In contrast, the control as shown in FIGS. 3 and 4 can directly and effectively reduce the surge pressure, that is, a sharp rise in the pump pressure Pd. That is because the control involves operating the opening area of the unload valve 50 so as to make the actual pump pressure Pd follow the target pressure Pdo that is calculated on the basis of the actuator holding pressure Pah (the head pressure Ph or the rod pressure Pr), the operation pressure, and the pressure loss, during the period from the opening of the control valve 30 to the actual start of the movement of the hydraulic cylinder 20.

According to the control described above, furthermore, fully closing the unload valve 50 at the point T1 in time when the hydraulic cylinder 20 is considered to have actually started to move enables a high driving speed of the hydraulic cylinder 20 to be ensured. Moreover, the full closing of the unload valve 50 at such a starting point T1 in time is less likely to involve the occurrence of surge pressure, differently from fully closing the unload valve 50 at the time of opening the control valve 30 as in the comparative example. The reason is as follows: as shown in FIG. 6, the pump pressure Pd is increased by the application of an operation to the operation lever which causes the control valve to be opened and causes the discharge amount of the pump to be increased, but opening the unload valve 50 prevents the pump pressure Pd from rising by an amount exceeding the restriction pressure.

Besides, the pump pressure Pd, being raised to at least the actuator holding pressure at a stage where an operation is applied to the operation lever, can quickly follow the pressure for activating the hydraulic cylinder 20 to thereby allow the responsibility to be improved.

In the case where the hydraulic pump is formed of a variable displacement hydraulic pump such as the hydraulic pump 10 to have a controllable pump capacity, the above control can be executed by the combination of the unload valve 50 formed of a pilot-operated selector valve having the pilot port 52 and the unload operation valve 56 formed of a solenoid valve for changing the pilot pressure to be input to the pilot port 52 to thereby generate an advantage of high flexibility in the applicable pump capacity control as compared with, for example, an apparatus which performs a load sensing control, which is based on the input of a load sensing pressure to an unload valve as the pilot pressure. The apparatus according to the above embodiment can execute the combination of, for example, the positive control based on the pilot pressure detected by the first and second pilot pressure sensors 62A and 62B (i.e. based on the magnitude of the cylinder operation) and the horsepower control based on the pump pressure Pd, while performing the pump pressure control effective for reducing surge pressure by the operation of the unload valve 50 through the unload operation valve 56.

The present invention is not limited to the embodiment described above. The present invention encompasses, for example, the following modes.

(A) Control Valve

The control valve according to the present invention only has to be capable of opening motion in response to an actuator operation applied to the operation device, not limited to the control valve 30 shown in FIG. 1, i.e. the three-position pilot-operated selector valve. The control valve according to the present invention, for example, may be also a two-position selector valve and may be also an electromagnetic selector valve.

(B) Operation Device

The operation device according to the present invention only has to allow an actuator operation to be applied thereto by an operator and to make the control valve perform an opening motion corresponding to the actuator operation. The operation device according to the present invention may be, for example, a combination of an electric lever device, a solenoid valve, and a pilot pressure command part. The electrical lever device converts an actuator operation applied to the electrical lever device into an operation signal that is an electrical signal. The solenoid valve performs opening and closing motions to change the pilot pressure that is input to the control valve. The pilot pressure command part inputs a pilot pressure command corresponding to the operation signal to the solenoid valve to thereby make the control valve perform an opening motion corresponding to the operation signal.

(C) Unload Operation Command Part

The unload operation command part according to the present invention only has to generate such an unload operation command as to make the actual pump pressure follow the target pressure thereof, the specific means for generating the unload operation command being therefore unlimited. The unload operation command part according to the present invention, specifically, is not limited to one that calculates an unload operation command for feedback control based on the deviation δPd of the pump pressure Pd from the target pressure Pdo as in the unload operation command part 76. The unload operation command part according to the present invention, for example, may be one that stores a map prepared for specifying the relationship between the input pump pressure and the actuator holding pressure and the unload operation command to be output, and determines the unload operation command using the map. In short, a sequence control may be performed.

In the present invention, the control of fully closing the unload valve based on the detection by the actuator motion detector is optional. The unload operation command part according to the present invention, for example, may be one that continues generation of such an unload operation command as to make the pump pressure follow the actuator holding pressure even after the start of the motion of the actuator.

(D) Pump Capacity Control

In the present invention, the pump capacity control is optional. The hydraulic pump according to the present invention, accordingly, is not limited to a variable displacement type hydraulic pump such as the hydraulic pump 10, but also allowed to be a fixed displacement type hydraulic pump.

As described above, there is provided a hydraulic drive apparatus installed in a work machine, the hydraulic drive apparatus enabling a hydraulic actuator to be reliably started in response to the opening of a control valve and effectively restraining a surge pressure from occurring at the time when the control valve is opened.

Provided is a hydraulic drive apparatus installed in a work machine including a movable element to hydraulically drive the movable element. The hydraulic drive apparatus includes a hydraulic pump, a hydraulic actuator, a control valve, an operation device, a pump pressure detector, an actuator holding pressure detector, an unload valve, an unload operation valve, a target pressure calculation part, and an unload operation command part. The hydraulic pump discharges hydraulic fluid. The hydraulic actuator is coupled to the movable element and operated to actuate the movable element by supply of hydraulic fluid discharged by the hydraulic pump to the hydraulic actuator. The control valve is interposed between the hydraulic pump and the hydraulic actuator, being openable so as to allow hydraulic fluid to be supplied from the hydraulic pump to the hydraulic actuator. The operation device receives an actuator operation for moving the hydraulic actuator to thereby make the control valve open in response to the actuator operation. The pump pressure detector detects a pump pressure which is a pressure of hydraulic fluid discharged by the hydraulic pump. The actuator holding pressure detector detects an actuator holding pressure that is a pressure required for holding the hydraulic actuator in a stopped state against a load applied to the hydraulic actuator. The unload valve is formed of a pilot-operated selector valve having a pilot port and provided in an unload line, configured to be opened at an opening degree corresponding to a pilot pressure that is input to the pilot port to thereby allow the hydraulic fluid to flow through the unload line at a flow rate corresponding to the opening degree. The unload line is disposed to allow hydraulic fluid discharged from the hydraulic pump to bypass the control valve and the hydraulic actuator to return directly to the tank. The unload operation valve is formed of a solenoid valve allowing an unload operation command to be input to the unload operation valve, being operable to change the pilot pressure to be input to the unload valve in response to the unload operation command. The target pressure calculation part calculates a target pressure of the pump pressure based on the actuator holding pressure detected by the actuator holding pressure detector. The target pressure calculation part calculates the target pressure so as to make the target pressure equal to or higher than a minimum pressure required for moving the hydraulic actuator against the load and equal to or lower than a preset restriction pressure. The unload operation command part generates the unload operation command and inputs the unload operation command to the unload operation valve. The unload operation command is a command to make the pump pressure detected by the pump pressure detector follow the target pressure.

According to the apparatus, the calculation of the target pressure and the control of the pump pressure based on the target pressure enables reliable operation of the hydraulic actuator to be ensured and enables a surge pressure to be restrained from occurring. In other words, the pump pressure is prevented from sharply raised accompanying the opening of the control valve. That is because the target pressure is calculated on the basis of the actuator holding pressure so as to be equal to or higher than the minimum pressure required for moving the hydraulic actuator against the load thereof and so as to be equal to or lower than the restriction pressure, and the pump pressure is controlled through the operation of the unload valve so as to make the pump pressure follow the thus calculated target pressure. Specifically, in the apparatus, the target pressure calculation part calculates the target pressure based on the actuator holding pressure, and the unload operation command part generates such an unload operation command as to make the pump pressure follow the target pressure and inputs the unload operation command to the unload operation valve. This prevents the pump pressure from being suddenly raised to cause the surge pressure, in spite of the sudden opening of the control valve in a state where the hydraulic actuator is stationary, while ensuring the pump pressure required for reliably operating the hydraulic actuator when the control valve is opened.

Specifically, the target pressure calculation part is preferably configured to calculate the target pressure so as to make the target pressure include an operation pressure corresponding to the magnitude of the actuator operation in addition to the actuator holding pressure. The target pressure including the actuator holding pressure allows the pump pressure to rapidly follow a pressure equal to or higher than the minimum pressure required for reliably operating the hydraulic actuator when the control valve is opened. Moreover, the target pressure, further including the operation pressure in addition to the actuator holding pressure, allows the responsibility of the actuator operation to the actuator operation to be ensured.

It is preferable that the target pressure calculation part is configured to calculate the target pressure so as to make the target pressure include an addition pressure in addition to the actuator holding pressure, the addition pressure being set to a value equal to or higher than the pressure loss from the hydraulic pump to the hydraulic actuator. The target pressure calculation part, thus making the addition pressure be included in the target pressure in addition to the actuator holding pressure, allows a control to be performed to improve the responsibility in consideration with the pressure loss that is to be a factor of response deterioration, with a simple calculation.

Preferably, the hydraulic drive apparatus further includes an actuator motion detector that detects a motion of the hydraulic actuator, wherein the unload operation command part is configured to input a command for fully closing the unload valve regardless of the pump pressure to the unload operation valve as the unload operation command, when the motion of the hydraulic actuator is detected. This allows hydraulic fluid that had been released through the unload line until the hydraulic actuator starts to move to be supplied to the hydraulic actuator, thereby enabling the operation speed of the hydraulic actuator to be increased. Moreover, fully closing the unload valve at the start time when the hydraulic actuator actually starts to move is unlikely to involve an occurrence of surge pressure, because the opening area of the unload valve has been already decreased to some extent by the starting time, and the actual motion of the hydraulic actuator (as compared to the case where the hydraulic actuator is stationary) reduces the compression of hydraulic fluid in the hydraulic actuator.

The control of the pump pressure in the hydraulic drive apparatus, which is performed based on the combination of the unload valve formed of a pilot-operated selector valve and the pilot-operated valve that is a solenoid valve for changing the pilot pressure to be input to the unload valve, provides a high flexibility in the pump capacity control despite the use of the unload valve. Specifically, in the case where the hydraulic pump is a variable displacement hydraulic pump configured to have a pump capacity that is a capacity of the hydraulic pump and changes in response to a capacity command signal that is input to the hydraulic pump, in short, in the case where a pump capacity control is possible, the unload control and the pump capacity control can be performed independently of each other. In this regard, the hydraulic drive apparatus is different from one that performs a so-called load sensing control based on a load sensing pressure that is input to an unload valve as a pilot pressure. For example, the hydraulic drive apparatus, preferably, further includes an actuator operation detector that detects a magnitude of the actuator operation applied to the operation device, and a pump capacity command part that generates a pump capacity command to increase the pump capacity of the hydraulic pump with an increase in the actuator operation and inputs the pump capacity command to the hydraulic pump, which allows both the unload control that prevents the pump pressure from being suddenly increased as described above and a so-called positive control that is a pump capacity control based on the actuator operation to be performed.

This application is based on Japanese Patent application No. 2020-038412 filed on Mar. 6, 2020 in Japan Patent Office, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A hydraulic drive apparatus for hydraulically driving a work machine including a movable element, the hydraulic drive apparatus comprising:

a hydraulic pump that discharges hydraulic fluid;

a hydraulic actuator coupled to the movable element and operated to actuate the movable element by supply of hydraulic fluid discharged by the hydraulic pump to the hydraulic actuator;

a control valve interposed between the hydraulic pump and the hydraulic actuator, the control valve being openable to allow hydraulic fluid to be supplied from the hydraulic pump to the hydraulic actuator;

an operation device that makes the control valve open in response to an actuator operation that is applied to the operation device for moving the hydraulic actuator;

a pump pressure detector that detects a pump pressure which is a pressure of the hydraulic fluid discharged by the hydraulic pump;

an actuator holding pressure detector that detects an actuator holding pressure which is a pressure required for holding the hydraulic actuator in a stopped state against a load applied to the hydraulic actuator;

an unload valve formed of a pilot-operated selector valve having a pilot port and provided in an unload line which allows hydraulic fluid discharged from the hydraulic pump to bypass the control valve and the hydraulic actuator to return directly to a tank, the unload valve configured to be opened at an opening degree corresponding to a pilot pressure that is input to the pilot port to thereby allow the hydraulic fluid to flow through the unload line at a flow rate corresponding to the opening degree;

an unload operation valve formed of a solenoid valve allowing an unload operation command to be input to the solenoid valve, the unload valve being operable to change the pilot pressure to be input to the unload valve in response to the unload operation command;

a target pressure calculation part that calculates a target pressure of the pump pressure based on the actuator holding pressure detected by the actuator holding pressure detector, so as to make the target pressure be a pressure equal to or higher than a minimum pressure required for moving the hydraulic actuator against the load and equal to or lower than a preset restriction pressure; and an unload operation command part that generates the unload operation command and inputs the unload operation command to the unload operation valve, the unload operation command being a command to make the pump pressure detected by the pump pressure detector follow the target pressure.

2. The hydraulic drive apparatus of the work machine according to claim 1, wherein the target pressure calculation part calculates the target pressure so as to make the target pressure include an operation pressure in addition to the actuator holding pressure, the operation pressure corresponding to a magnitude of the actuator operation.

3. The hydraulic drive apparatus of the work machine according to claim 1, wherein the target pressure calculation part calculates the target pressure so as to make the target pressure include an addition pressure in addition to the actuator holding pressure, the addition pressure corresponding to a pressure loss from the hydraulic pump to the hydraulic actuator.

4. The hydraulic drive apparatus of the work machine according to claim 1, further comprising an actuator motion detector that detects a motion of the hydraulic actuator, wherein the unload operation command part is configured to input a command for fully closing the unload valve to the unload operation valve regardless of the pump pressure, as an unload operation command, when the motion of the hydraulic actuator is detected.

5. The hydraulic drive apparatus of the work machine according to claim 1, wherein the hydraulic pump is a variable displacement type hydraulic pump, having a pump capacity which is an capacity of the hydraulic pump and is changed in response to a capacity command signal that is input to the hydraulic pump, the hydraulic drive apparatus further comprising: an actuator operation detector that detects a magnitude of the actuator operation applied to the operator; and a pump capacity command part that generates a pump capacity command to increase the pump capacity of the hydraulic pump with increase in the actuator operation and inputs the pump capacity command to the hydraulic pump.

* * * * *